United States Patent [19]

Kageyama

[11] Patent Number: 4,627,756

[45] Date of Patent: Dec. 9, 1986

[54] LEAD PROPELLING MECHANISM FOR A MECHANICAL PENCIL

[75] Inventor: Hidehei Kageyama, Kawagoe, Japan

[73] Assignee: Kotobuki & Co., Ltd., Kyoto, Japan

[21] Appl. No.: 765,128

[22] Filed: Aug. 13, 1985

[30] Foreign Application Priority Data

Apr. 2, 1985 [JP] Japan ..... 60-48121[U]

[51] Int. Cl.[4] ..... B43K 21/22; B43K 21/04

[52] U.S. Cl. ..... 401/94; 401/53; 401/65; 401/67

[58] Field of Search ..... 401/53, 65, 67, 94

[56] References Cited

U.S. PATENT DOCUMENTS 4,205,924 6/1980 Sumita ..... 401/67
4,386,865 6/1983 Kageyama et al. ..... 401/67

FOREIGN PATENT DOCUMENTS 43171 5/1968 Fed. Rep. of Germany ..... 401/67
2838049 3/1979 Fed. Rep. of Germany ..... 401/67
3018850 11/1980 Fed. Rep. of Germany ..... 401/67
3215725 11/1982 Fed. Rep. of Germany ..... 401/53
555350 5/1978 Japan ..... 401/67

*Primary Examiner*—Richard J. Apley
*Assistant Examiner*—Alfedo Acoff
*Attorney, Agent, or Firm*—Sherman and Shalloway

[57] ABSTRACT

A lead propelling mechanism for a mechanical pencil includes a lead chuck, a ring fitted loosely about the chuck for tightening its head, a sleeve having a front end contacting the ring, and an elastic member having a front end bearing on the front end of the sleeve and a rear end held by a shoulder formed on the outer surface of the chuck adjacent to its rear end. The mechanism is very easy to assemble and join to a lead holding tube in the pencil. The rear end of the elastic member bears against an adjacent end of the tube to urge the ring to tighten the head of the chuck, when the chuck is inserted into the tube.

6 Claims, 10 Drawing Figures

LEAD PROPELLING MECHANISM FOR A MECHANICAL PENCIL

BACKGROUND OF THE INVENTION

1. Field of the Invention

This invention relates to a lead propelling mechanism for a mechanical pencil. More particularly, it relates to a lead propelling mechanism including a lead chuck having means for engaging an elastic member for tightening the chuck, and which is, therefore, easy to assemble.

2. Description of the Prior Art

A known mechanical pencil is shown by way of example in FIG. 1. It includes a lead holding tube 1 and a lead propelling mechanism 7 attached to the front end of the tube 1. The mechanism 7 comprises a lead chuck 2, a ring 3 for tightening the chuck 2, a sleeve 4, a spring 5 for absorbing any excessive writing pressure, and a spring 6 for tightening the chuck 2. When the lead propelling mechanism 7 is joined to the lead holding tube 1, the ring 3, the sleeve 4 and the spring 6 are first inserted over the chuck 2 past its rear end and the chuck 2 is, then, fitted into the front end of the tube 1. It is, however, often difficult to fit the chuck 2 in the tube 1 quickly, since the spring 6 abuts on the front end of the tube 1 and urges it back. It is necessary to hold the spring 6 by a finger or some mechanical device so that it may not push the tube 1 back. Thus, the assembly of the lead propelling mechanism with the lead holding tube has hitherto been a considerably inefficient job.

SUMMARY OF THE INVENTION

Under these circumstances, it is an object of this invention to provide a lead propelling mechanism for a mechanical pencil which can very easily and efficiently be joined with a lead holding tube.

This object is attained by a lead propelling mechanism including a lead chuck having means for engaging an elastic member for tightening the chuck, so that when the mechanism is joined to the tube, it can be handled as if it were a single member.

DETAILED DESCRIPTION OF THE PREFERRED EMBODIMENTS

Figure 1:
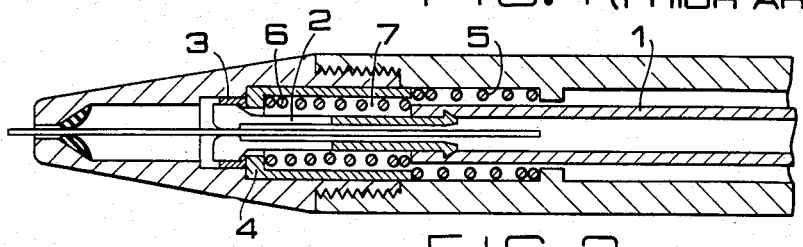
FIG. 1 (PRIOR ART)
FIG. 1 is a fragmentary longitudinal sectional view of a known mechanical pencil.
Figure 2:
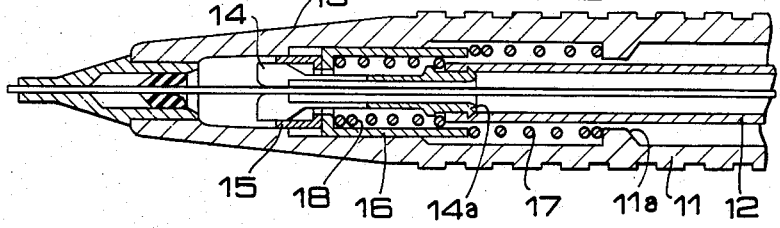
FIG. 2 is a fragmentary longitudinal sectional view of a mechanical pencil embodying this invention.

Referring first to FIG. 2, there is shown a mechanical pencil including a lead propelling mechanism embodying this invention. It includes a lead holding tube 12 which is axially slidable in a housing 11. The lead propelling mechanism is generally shown at 13 and attached to the front end of the tube 12.

The lead propelling mechanism 13 comprises a lead chuck 14 having a rear end fitted in the front end of the tube 12, a chuck tightening ring 15 fitted about the chuck 14 adjacent to the front end, or head thereof, a sleeve 16 surrounding the chuck 14 and holding the ring 15 against axial displacement, a first elastic member 17 disposed between the housing 11 and the tube 12 for absorbing any excessive writing pressure, and a second elastic member 18 disposed between the chuck 14 and the sleeve 16 for tightening the chuck 14. The housing 11 is formed on its inner wall surface with an annular projection **11*a* spaced apart from the rear end of the sleeve 16. The first elastic member 17 has a front end contacting the rear end of the sleeve 16 and a rear end contacting the projection 11*a*. The sleeve 16 has at its front end a radially inwardly projecting flange contacting the ring 15. The second elastic member 18 has a front end contacting the flange of the sleeve 16 and a rear end contacting the front end of the tube 12**.

Figure 3:
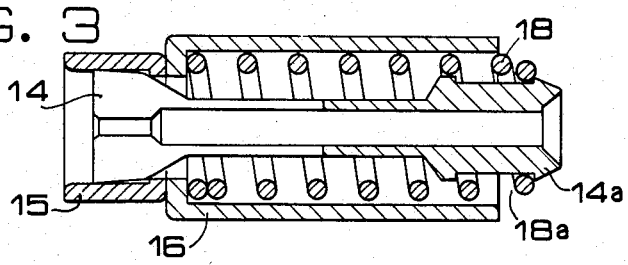
FIG. 3 is an enlarged longitudinal sectional view of a portion of the pencil shown in FIG. 2.

According to a salient feature of this invention, the lead chuck 14 has at its rear end an annular shoulder **14*a* which is provided not only for securing the chuck 14 to the tube 12 when the mechanism 13 is joined to the tube 12, but also for holding the rear end 18*a* of the second elastic member 18, as shown in FIG. 3, until the chuck 14 is properly fitted in the tube 12. The elastic member 18 has a smaller diameter at its rear end 18*a* than in the remaining portion thereof. The rear end 18*a* is, however, elastic enough to ride over the shoulder 14*a* on the chuck 14 when the elastic member 18 is fitted about the chuck 14, and once the elastic member 18 is fitted about the chuck 14, its rear end 18*a* is held by the shoulder 14*a* so that it may not easily come off the shoulder 14*a***.

When the lead propelling mechanism 13 is assembled and joined to the tube 12, the ring 15, the sleeve 16 and the second elastic member 18 are first fitted about the chuck 14 past the rear end thereof until the rear end **18*a* of the elastic member 18 is engaged by the shoulder 14*a* on the chuck 14. The elastic member 18 extending elastically between the shoulder 14*a* and the front end of the sleeve 16 holds the other parts of the mechanism 13, except the first elastic member 17, together, so that the mechanism 13, except the first elastic member 17, is easy to handle as if it were a single member. It is no longer necessary to hold the second elastic member 18 by a finger or any device when the mechanism 13 is joined to the tube 12. The lead propelling mechanism 13 can, therefore, be joined to the tube 12 very easily and efficiently. When the chuck 14 is inserted into the tube 12, the elastic member 18 is compressed as its rear end is pushed by the front end of the tube 12, so that a sufficiently long rear end portion of the chuck 14 can be fitted in the front end portion of the tube 12** and secured therein.

Figure 4:
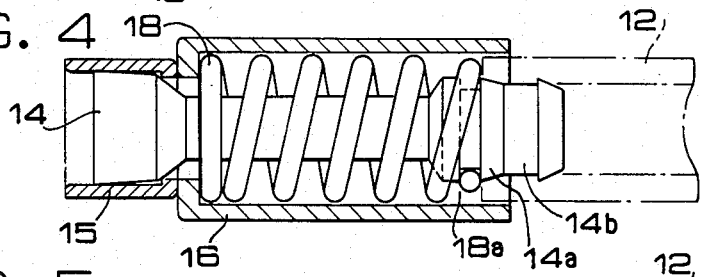
FIGS. 4 to 8 are fragmentary enlarged longitudinal sectional views showing other embodiments of this invention.
Figure 5:
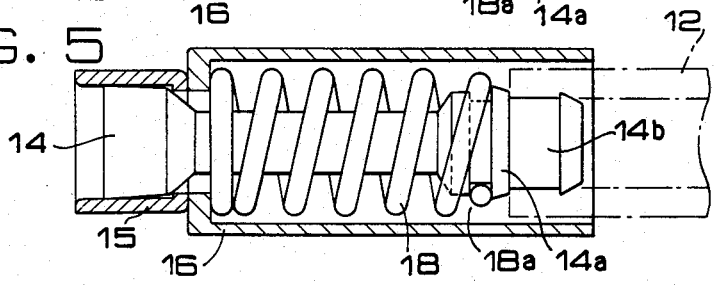

FIGS. 4 and 5 show different embodiments of this invention each characterized by a lead chuck 14 having a shoulder **14*a* formed at a distance from its rear end for holding the rear end 18*a* of a second elastic member 18. The lead chuck 14 shown in each of FIGS. 4 and 5 has a free rear end portion 14*b* defined between its shoulder 14*a* and its rear end. The rear end portion 14*b* is free from the elastic force of the elastic member 18 and thereby facilitates the insertion of the chuck 14 into the tube 12. The devices shown in FIGS. 4 and 5 are substantially identical to each other and differ from each other only in that the shoulder 14*a* on the chuck 14 in FIG. 4 is fitted in the front end of the tube 12, while the shoulder 14*a* in FIG. 5** is located outwardly thereof.

Figure 6:
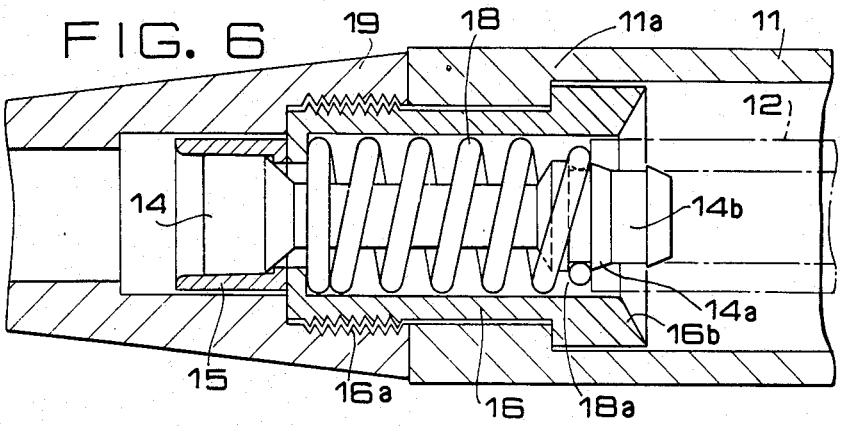

Referring to FIG. 6, another embodiment of this invention is characterized by a sleeve 16 having an outer peripheral surface formed adjacent to its front end with a screw thread 16*a* which is engageable with a screw thread formed on the inner peripheral surface of a pencil tip member 19 adjacent to its rear end. The sleeve 16 is also provided at its rear end with a radially outwardly projecting annular shoulder 16*b* abutting on an annular shoulder 11*a* on the inner peripheral surface of a housing 11. The sleeve 16 shown in FIG. 6 has the advantage of facilitating the connection of the tip member 19 to the housing 11. The device shown in FIG. 6 includes a lead chuck 14 which is identical in construction to the lead chuck 14 shown in FIG. 4.

Figure 7:
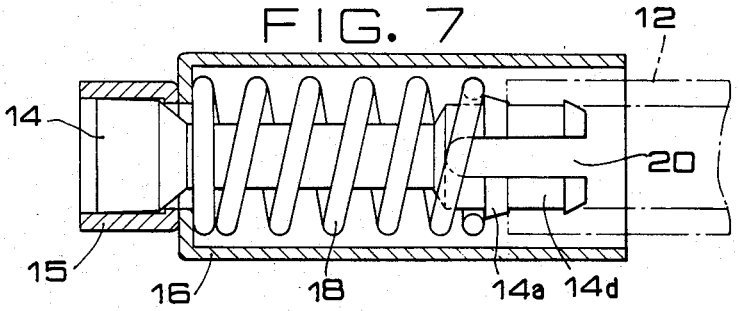

Still another embodiment of this invention is shown in FIG. 7. It is identical to the device shown in FIG. 5, except that the chuck 14 has a slit 20 extending from its rear end to a portion beyond the shoulder 14*a* and defining a split rear end portion 14*d*. The slit 20 facilitates the insertion of the elastic member 18 about the chuck 14 and the insertion of the chuck 14 into the tube 12.

Figure 8:
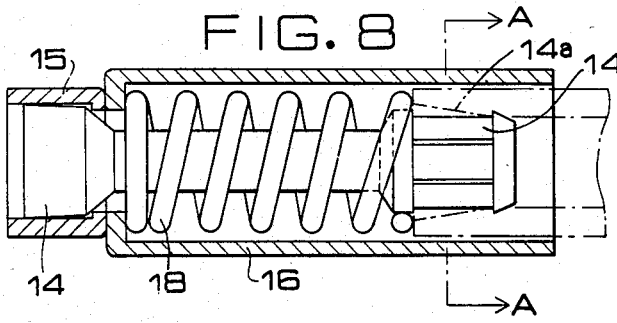
Figure 9:
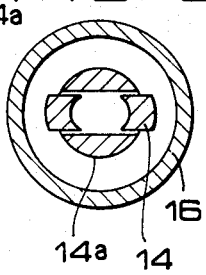
FIG. 9 is a sectional view taken along the line A—A of FIG. 8.

Still another embodiment of this invention is shown in FIGS. 8 and 9. It is characterized by including a lead chuck 14 having a shoulder 14*a* for holding the rear end of a second elastic member 18 which comprises a pair of split shoulder portions defined by a slit formed at the rear end of the chuck 14. The split portions of the shoulder 14*a* are substantially radially inwardly compressible from their positions shown by broken lines in FIG. 8 to their positions shown by solid lines when the rear end of the chuck 14 is inserted into the tube 12.

Figure 10:
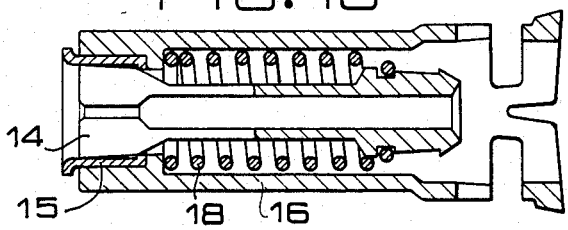
FIG. 10 is a fragmentary longitudinal sectional view showing still another embodiment of this invention.

A further embodiment of this invention is shown in FIG. 10 and characterized by including a sleeve 16 having a specially shaped elastic portion 16*a* at its rear end. The elastic portion 16*a* is provided for absorbing any excessive writing pressure and thereby eliminates the necessity for the provision of the first elastic member. The device of FIG. 10 is, therefore, still easier to assemble.

While the lead chuck 14 has been described or shown in each of the embodiments of this invention as a single member, it may alternatively comprise a plurality of separate longitudinal members. In any such event, the elastic member 18 is not only provided for tightening the chuck when the pencil is used for writing, but also serves to hold the chuck members together at the rear end 18*a* thereof.

As is obvious from the foregoing description, this invention is particularly characterized by the shoulder provided on the lead chuck for holding the rear end of the chuck tightening elastic member. The lead propelling mechanism of this invention can, therefore, be handled as if it were a single member, and can be assembled and joined to the lead holding tube very easily and efficiently.

What is claimed is:

1. A lead propelling mechanism for a mechanical pencil comprising:

a lead chuck having a front end defining its head and a rear end, said chuck having on its outer peripheral surface a groove including a shoulder located adjacent to said rear end thereof;

a ring fitted loosely about said chuck for tightening said head thereof;

a sleeve having a front end contacting said ring; and a coiled spring having a front end bearing on said front end of said sleeve and a rear end held by said shoulder, said rear end of said spring being adapted to bear against an adjacent end of a lead holding tube to urge said ring to tighten said head; and said spring having a smaller diameter at its rear end portion defining said rear end, and a larger substantially uniform diameter in the remaining portion thereof, solely said smaller diameter rear end portion being contained within said groove.

2. A mechanism as set forth in claim 1, wherein said shoulder is located at a distance from said rear end of said chuck.

3. A mechanism as set forth in claim 1, wherein said sleeve is provided adjacent to said front end thereof with means which is engageable with a pencil tip member, while said sleeve is also provided at its rear end with a shoulder which is engageable with a shoulder formed in a pencil housing, said means and shoulder on said sleeve cooperating to join said tip member and said housing together.

4. A mechanism as set forth in claim 1, wherein said shoulder comprises a plurality of split portions which are compressible toward each other when it is inserted into said end of said tube.

5. A mechanism as set forth in claim 1, wherein said sleeve has an elastically deformable portion.

6. A mechanism as set forth in claim 3, wherein said means comprises a screw thread formed on the outer peripheral surface of said sleeve and adapted for engagement with a screw thread formed on the inner peripheral surface of said tip member.

* * * * *